United States Patent [19]

Johnson

[11] 4,127,021

[45] Nov. 28, 1978

[54] TUBE FLARING SET

[76] Inventor: Andrew L. Johnson, 5346 Greenleaf, Skokie, Ill. 60076

[21] Appl. No.: 746,417

[22] Filed: Dec. 1, 1976

[51] Int. Cl.[2] ..... B21D 41/02

[52] U.S. Cl. ..... 72/313; 72/317

[58] Field of Search ..... 72/316, 317, 318, 312, 72/313, 314; 269/104, 126, 127, 129, 138, 217, 234, 290

[56] References Cited

U.S. PATENT DOCUMENTS

| | | | |
|---|---|---|---|
| 2,132,947 | 10/1938 | Gagne | 72/317 |
| 2,438,999 | 4/1948 | Hartley et al. | 72/316 |
| 2,478,102 | 2/1949 | Hull et al. | 72/312 |
| 2,993,522 | 7/1961 | Temple et al. | 72/312 |
| 3,027,931 | 4/1962 | Franck | 72/317 |
| 3,345,855 | 10/1967 | Franck | 72/317 |

FOREIGN PATENT DOCUMENTS

| | | | |
|---|---|---|---|
| 1,918,815 | 10/1970 | Fed. Rep. of Germany | 72/316 |

*Primary Examiner*—Michael J. Keenan

*Attorney, Agent, or Firm*—Darbo & Vandenburgh

[57] ABSTRACT

The two bars that form the tubing gripper have tapered sides which mate with corresponding tapered faces on the two legs of the yoke. The direction of the tapering is such that as the flaring cone is forced against the end of a tube in the gripper, the tapered sides of the yoke legs cam the two bars of the gripper together to securely hold the tube in the gripper. A threaded bolt having a wing nut thereon is employed to initially press the bars of the gripper together with a sufficient force to hold the tube in the gripper while the yoke is put in place and the flaring cone initially pressed against the end of the tube.

6 Claims, 3 Drawing Figures

TUBE FLARING SET

BACKGROUND AND SUMMARY OF THE INVENTION

One form of tube flaring tools commercially available comprises a pair of elongated bars which cooperate to define a plurality of openings of various sizes between them. Each opening is respectively sized to receive a tube of a standard size and to permit the bars to grip the tube when the bars are pressed toward each other. Various devices are utilized to so press the bars together. The tubing is then so gripped while a flaring cone is forced against the end of the tube to flare that end.

The device for forcing the bars together has two primary requirements, namely, (1) it must develop sufficient force urging the bars together to securely hold the tube between the bars, and (2) it should be readily operable to apply and release that pressure. These two requirements are not entirely consonant. Thus as the flaring cone is pressed against the end of the tube, the force so applied tends to cause the tube to slide out from between the bars. To offset this tendency, considerable pressure must be applied urging the bars together so as to securely hold the tube against slippage. When utilizing bolts at each end of the bars, which bolts have wing nuts on them (as is a common practice), for developing this pressure, it is necessary to tighten the wing nuts very tight. This is difficult, both in the tightening and in the loosening of the nuts.

An additional disadvantage of such devices commercially available is that it may be time-consuming to place the yoke (on which the flaring cone is mounted) onto the bar. The bolts and nuts on the ends of the bars, when in place, prevent the yoke from being slid onto the bars from the ends. While in most such devices, the yoke may be rotated approximately 90° from the position in which it is used and then fitted onto or off the pair of bars, this requires that the flaring cone be backed off substantially from the position at which it is used during the flaring operation. So backing off the flaring cone and subsequently moving it into working position can be time-consuming.

The principal object of the present invention is to provide an arrangement whereby the yoke serves to cam the bars together during the flaring operation. This eliminates the necessity of a separate device for this purpose, such as the bolts and wing nuts previously referred to. The more force that the flaring cone applies to the end of the tube, the greater will be the camming pressure urging the bars together about the tube being flared. Furthermore, this pressure is applied directly at the location of the tube being gripped, rather than at a remote location such as occurs with the bolts and wing nuts previously referred to. Since there are no bolts and wing nuts at the ends of the bars, the yoke can easily be moved off the ends of the bars in a direction longitudinally thereof.

In a further aspect of this invention, there is a centrally located bolt and wing nut employed to initially press the bars together sufficiently to hold a tube between them until the yoke is in place and the flaring force commences. Of course, as the flaring force commences applying pressure to the end of the tube, it initiates the camming action to press the bars together to resist tendency of the flaring force to move the tube out from between the bars.

Further objects and advantages will become apparent from the following description and the appended drawing.

DESCRIPTION OF SPECIFIC EMBODIMENT

Figure 1:
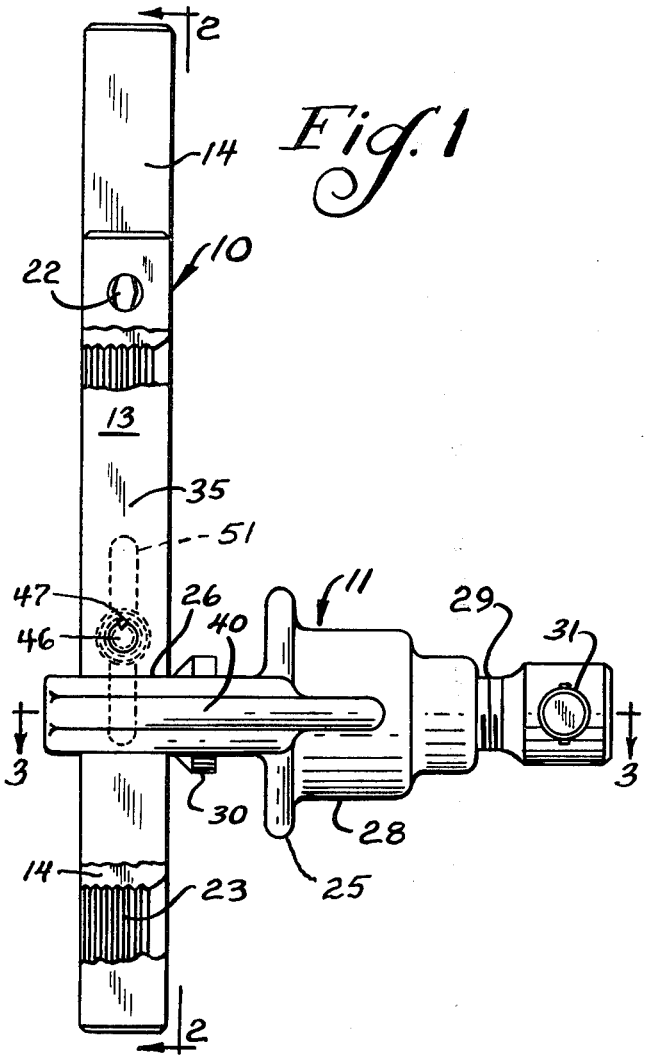
FIG. 1 is a side view of an embodiment of the invention.
Figure 2:
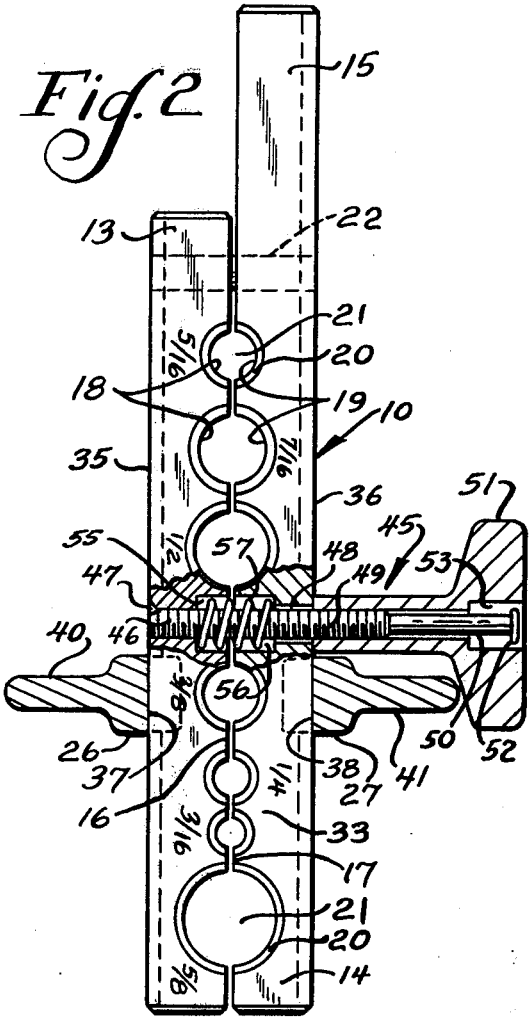
FIG. 2 is a view as seen at line 2-2 of FIG. 1, with portions broken away.

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

The illustrated embodiment comprises an elongated tube gripper, generally 10, and a device, generally 11, for flaring the end of a piece of tube 12 being held by the tube gripper. The tube gripper is formed by a pair of bars 13 and 14. Bar 14 has an elongated end 15 which may be placed in a vise to support the tube gripper. These bars mate with each other at inner faces 16 and 17. These inner faces have a plurality of approximately semi-cylindrical recesses 18 and 19 therein. When the bars are mated these recesses thus define a plurality of approximately cylindrical openings 21 having their axes approximately parallel. The openings 21 are of various diameters, proportioned in accordance with the peripheral size of various sizes of standard tube. On one face (hereinafter referred to as the top) of the gripper 10, the sides of the gripper about the openings are formed with a bevel 20. So that the recesses mate properly to define the desired openings, a pin 22 is secured to one of the bars and slips into a socket in the other of the bars. To facilitate gripping the tube securely, the face of the recesses 18 and 19 is formed with a plurality of sharp ridges and grooves as illustrated at 23.

The flaring device 11 comprises a yoke 25 formed by a pair of legs 26 and 27 integral with a hub 28. The hub is internally threaded to receive a threaded stem 29. A flaring cone 30 is positioned between legs 26 and 27 and is rotatably mounted on the end of stem 29. On the other end of the stem is a bar handle 31 slideably received in an opening on the end of the stem.

As thus far described, the structure is generally representative of commercially available tube flaring apparatus, except perhaps for the particular alignment pin 22. When a tube is positioned in an appropriate one of openings 21 and a clamping pressure applied to hold the bars 13 and 14 firmly against the tube, the tube is flared by forcing the flaring cone 30 against that end of the tube. The flaring cone pushes the end of the tube outwardly against the beveled sides 20 of the openings 21. The end of the tube is thus permanently deformed into the desired shape. After being so deformed, the cone is retracted, the yoke 25 separated from the tube gripper 10, the clamping pressure is removed and then the bars 13 and 14 moved apart so as to permit the flared end of the tubing to pass through the opening 21 in which it had been positioned.

Figure 3:
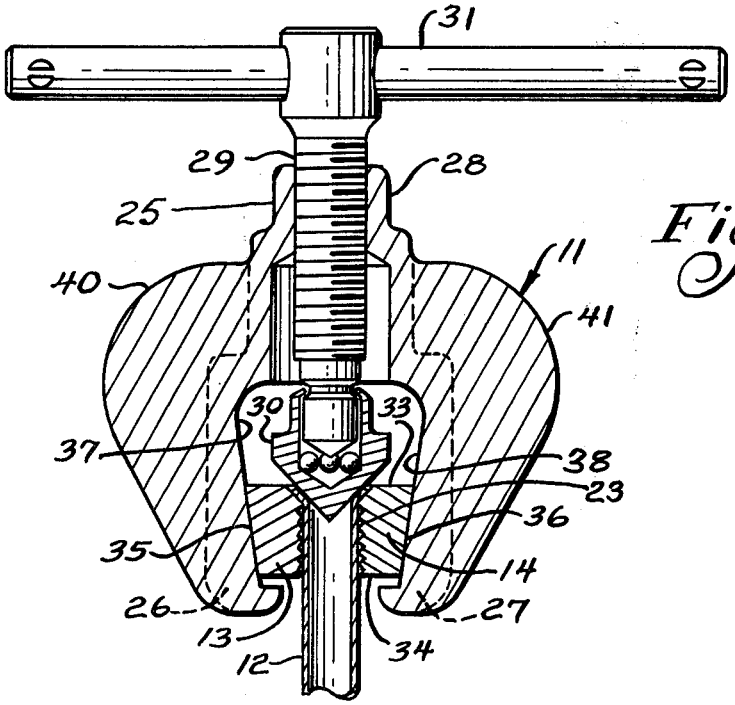
FIG. 3 is a section as seen at line 3-3, with a piece of tube being flared.

For convenience in describing my invention, the side of the gripper 10, which includes the beveled faces 20 about the openings, will be referred to as the top 33 of the gripper and the opposite side will be referred to as the bottom 34. It will be readily apparent, however, that such orientation with respect to the vertical is not necessary in the use of the tube flaring apparatus. The tube gripper has two opposed sides 35 and 36 which connect the top and bottom. While in prior art devices these sides are normal to the top and bottom, in my invention they are beveled so that at the bottom of the gripper they are closer together than they are at the top. The inner faces 37 and 38 of legs 26 and 27, respectively, are correspondingly beveled. Thus as pressure is applied to the end of tube 12 by the cone 30, that pressure urges the yoke 25 upwardly as viewed in FIG. 3. This results in the legs 26 and 27 applying a camming force to the bars 13 and 14, which camming force supplies the pressure holding the bars tightly together so that the tube 12 will be firmly held between the bars while it is flared. To accomplish this it is important that the camming force not move the legs 26 and 27 apart. To this end, the legs are provided with external flanges or ribs 40 and 41. When the tube has been flared to the desired extent, the stem 29 is backed off (moved upwardly in FIG. 3) thus backing off the flaring cone. This permits the yoke to be moved downwardly and thereby relieve the clamping pressure. Since there are no obstructions on the ends of the gripper, the yoke may be moved off the adjacent end, whereupon the bars may be separated to permit the flared end of the tube to pass through the opening in which it was seated.

While it is not needed for the purpose of applying a clamping pressure while the flaring cone is being pressed against the end of the tube, it is convenient to have a supplemental clamping device to initially apply a clamping force on the tube while the flaring device 11 is being mounted on the tube gripper 10. This supplemental clamping device includes a bolt 46. It is threaded into bar 13 and staked, as at 47, to prevent it from unscrewing from the bar. The bolt extends loosely through opening 48 in bar 14. The portion of the bolt extending beyond bar 14 comprises an initial threaded part 49 and an outer, distal, unthreaded part 50. The threaded part is of relatively short axial length. The unthreaded part is of substantially greater axial length. A wing nut 51 has internal threads to engage the threads of bolt 46. The diameter of the unthreaded part 50 of the bolt is sufficiently small to move freely through the threads of the wing nut 51. On the outer end of the bolt is a head 52 sufficiently large to not pass through the threads of the wing nut, thereby captivating the wing nut on the bolt. The wing nut has an opening 53 which provides space to permit the head 52 to be swaged on the bolt after the wing nut is put in place.

Coaxial with the bolt the bars 13 and 14 have cylindrical openings 55 and 56. This permits a compression spring 57 to be positioned on the bolt and between the bars. As the wing nut 51 is loosened the spring pushes the bars apart.

Initially when a tube is to be flared, the flaring device 11 will be separate from the tube gripper 10. The end of the tube is slipped into the appropriately sized opening 21. Wing nut 51 is screwed down on bolt 56 to press against bar 14 and urge that bar toward bar 13. An initial gripping force is thereby easily applied to the tube 12 to hold the tube in the gripper while the flaring device is being put into position to perform the flaring operation. The yoke of the flaring device is then slipped onto the adjacent end of the tube gripper and positioned on the gripper so that legs 26 and 27 are diametrically opposite the opening 21 in which the tube has been previously positioned. Handle 31 is then employed to turn stem 29 in a direction such as to move flaring cone 30 toward and into the end of the tube. As this occurs, the yoke then takes over to apply the required clamping pressure to the tube gripper, as previously described.

After the end of the tube has been flared and the flaring device 11 again separated from the tube gripper, as previously described, wing nut 51 is backed off. As this occurs, the spring 57 urges the bars 13 and 14 apart. Since the wing nut only is engaging the threaded part 49 of short axial length, it quickly becomes disengaged from that part and thereafter can move freely away from bar 14 along the unthreaded part 50 of the bolt.

I claim:

1. In an apparatus for forming the ends of tubes and comprising an elongated tube gripper having a top, a bottom, two sides, and a plurality of openings extending between the top and bottom with the openings at the top being enlarged, said openings being formed about substantially parallel axes and being of various diameters to accommodate tubing of various sizes, said gripper being formed by two elongated mating bars, each of which defines all of one of said sides respectively and approximately half of the width of each of said openings;

means for clamping said bars together to hold a tube in one of said openings with an end of the tube adjacent the enlarged part of the one opening; and a device for engaging said gripper and applying pressure against said end of the tube in a manner to press the end outwardly and into the enlarged part of the opening to thereby form said one end of the tube, said device including a yoke comprising a hub adapted to be positioned in juxtaposition to said top, and a pair of legs each extending from said hub along a respective side, the improvement wherein said means comprises:

said sides tapering toward each other in a top to bottom direction, and each leg having a face adjacent the respective side, in contact with the respective side and tapered corresponding to the respective side, whereby as a said pressure is applied to said end of the tube that pressure tends to move the legs in a bottom to top direction and said faces thereby cam the sides toward each other as a result of said tapering to develop said pressure without the necessity for other elements to apply such pressure.

2. In an apparatus as set forth in claim 1, including pin means extending between said bars to position said bars so that the half openings in each bar are in alignment with the half openings in the other bar.

3. In an apparatus as set forth in claim 1, including supplemental means interconnecting the bars for applying a force clamping the bars together sufficient to initially hold a tube between the bars while said device is being manipulated to commence applying said pressure to the end of the tube.

4. In an apparatus as set forth in claim 3, wherein said supplemental means is located only intermediate two adjacent openings.

5. In an apparatus as set forth in claim 4, wherein the supplemental means includes a bolt secured to one bar and loosely extending through the other bar, and a nut on said bolt, engaging the threads thereof and bearing against said side defined by said other bar.

6. In an apparatus as set forth in claim 5, wherein the part of the bolt extending beyond the side of the other bar comprises a threaded part adjacent said other bar and a second part remote from said other bar, said second part being smaller in cross-section than the diameter of the opening within the threads of the nut, whereby when the nut is backed off said threaded part said nut will move freely on said second part;

including means captivating said nut on said bolt; and including spring means between the bars for resiliently urging the bars apart.

* * * * *

Disclaimer 4,127,021.—*Andrew L. Johnson,* Skokie, Ill. TUBE FLARING SET. Patent dated Nov. 28, 1978. Disclaimer filed Dec. 18, 1978, by the inventor.

Hereby enters this disclaimer to claims 1 through 5 inclusive of said patent.

[*Official Gazette January 26, 1982.*]